US005813200A

United States Patent [19]

Jacoby et al.

[11] Patent Number: 5,813,200

[45] Date of Patent: Sep. 29, 1998

[54] PACKAGING AND DISPOSAL SYSTEM

[75] Inventors: Charles J. Jacoby, Bentleyville; John R. Hickman, Tallmadge; Michael J. Gallo, Twinsburg, all of Ohio

[73] Assignee: Mondial Industries, Ltd., Streetsboro, Ohio

[21] Appl. No.: 768,034

[22] Filed: Dec. 17, 1996

[51] Int. Cl.[6] ..... B65B 9/15; B65B 7/12; B65B 9/08

[52] U.S. Cl. ..... 53/567; 53/576; 53/549; 53/390

[58] Field of Search ..... 53/390, 567, 570, 53/576, 549

[56] References Cited

U.S. PATENT DOCUMENTS 4,869,049 9/1989 Richards et al. ..... 53/567 X
4,917,393 4/1990 Rogers ..... 53/390 X
5,590,512 1/1997 Richards et al. ..... 53/567
5,651,231 7/1997 Garland ..... 53/390 X

*Primary Examiner*—Horace M. Culver
*Attorney, Agent, or Firm*—Reinhart, Boerner, Van Deuren, Norris & Rieselbach, s.c.

[57] ABSTRACT

A packaging and disposal system for sealing waste and related materials within flexible plastic tubing for odorless and sanitary disposal. Improvements in the latch, including the addition of a transverse mounted latch spring, and improvements in the support retention springs serve to increase the ability of the device to operate efficiently and effectively and reduce the potential of accidental spills or other exposure of the waste package. The latch requires two independent motions to actuate and incorporates a transversely mounted latch spring. The reduced cross-sectional area of the retention spring design concentrates force applied to the package to increase the effective holding ability of the system.

11 Claims, 4 Drawing Sheets

PACKAGING AND DISPOSAL SYSTEM

BACKGROUND OF THE INVENTION

The present invention relates generally to a disposal device using packs of flexible tubing in packaging, and more particularly, to an improved apparatus and method for the sanitary and odorless disposal of diapers and similar or related waste.

Prior devices incorporating flexible tubing are used to dispose of diapers filled with waste by twisting plastic lining at the end of a diaper to seal each diaper individually. As more diapers are added, the previously sealed waste packages are pushed further into the container. A series of waste packages is created, each package contained within the plastic tubing and sealed at each end by the twisting process. When the container reaches capacity, the flexible tubing is severed, and the series of sealed waste packages is removed through an access door at the bottom of the container.

On prior devices, lids can be disengaged merely by supplying sufficient force while lifting the lid. One preferred embodiment of the present invention includes a hinged lid secured with a latch incorporating a transversely mounted latch spring with dual catches. This latch requires two definite and independent motions to open the hinged lid.

The retention springs in the disposal device are designed to hold the waste stationary while the flexible tubing which surrounds the waste is twisted. One embodiment of the present invention allows a greater variety of products to be introduced into the disposal system. A further improvement of the present invention is the retention spring design and location which allows the springs to act independently, and in concert with, adjacent springs to accept a larger variety of waste sizes, shapes, and consistencies while allowing the flexible tubing to change shape independently. The retention springs incorporated into one preferred embodiment of the present invention, therefore, are flexible enough to accommodate pliant waste packages while providing sufficient force to stabilize the waste packages during the twisting and sealing process. Further, the retention springs of the present invention retain their general shape and engagement with the waste package during the twisting and sealing process.

The present invention decreases the possibility that the lid can come loose and increases the sealing ability of the device. Both of these conditions, a loose lid and an insufficient seal on a package, may result in odor and unsanitary conditions. The novel latch spring secures the hinged lid to the cover of the disposal device. Retention springs designed in accordance with the invention better support and hold waste packages stationary while the device used to seal packages. Further, a reduction in the cross-sectional area of the retention springs distributes force over a smaller area, increasing the effective retention force and preventing the waste packages from deviating while being sealed. In addition, waste packages can be pushed through the retention springs into the cylindrical container more easily.

It is therefore an object of the present invention to provide a sanitary apparatus and method which uses flexible tubing to dispose of waste such as disposable diapers.

It is a further object of the present invention to provide a disposal apparatus and method which effectively contains odors.

It is still another object of the present invention to provide an improved disposal apparatus and method which remains closed when the device is tipped or jarred and prevents accidental spills.

It is yet another object of the present invention to provide an improved disposal apparatus and method capable of sealing waste inside flexible tubing which more securely stabilizes the package while the device is rotated to twist and seal the waste package.

It is a further object of the present invention to provide a sanitary disposal apparatus and method which incorporates tapered retention springs engaging packages.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DETAILED DESCRIPTION OF PREFERRED EMBODIMENTS

Figure 1:
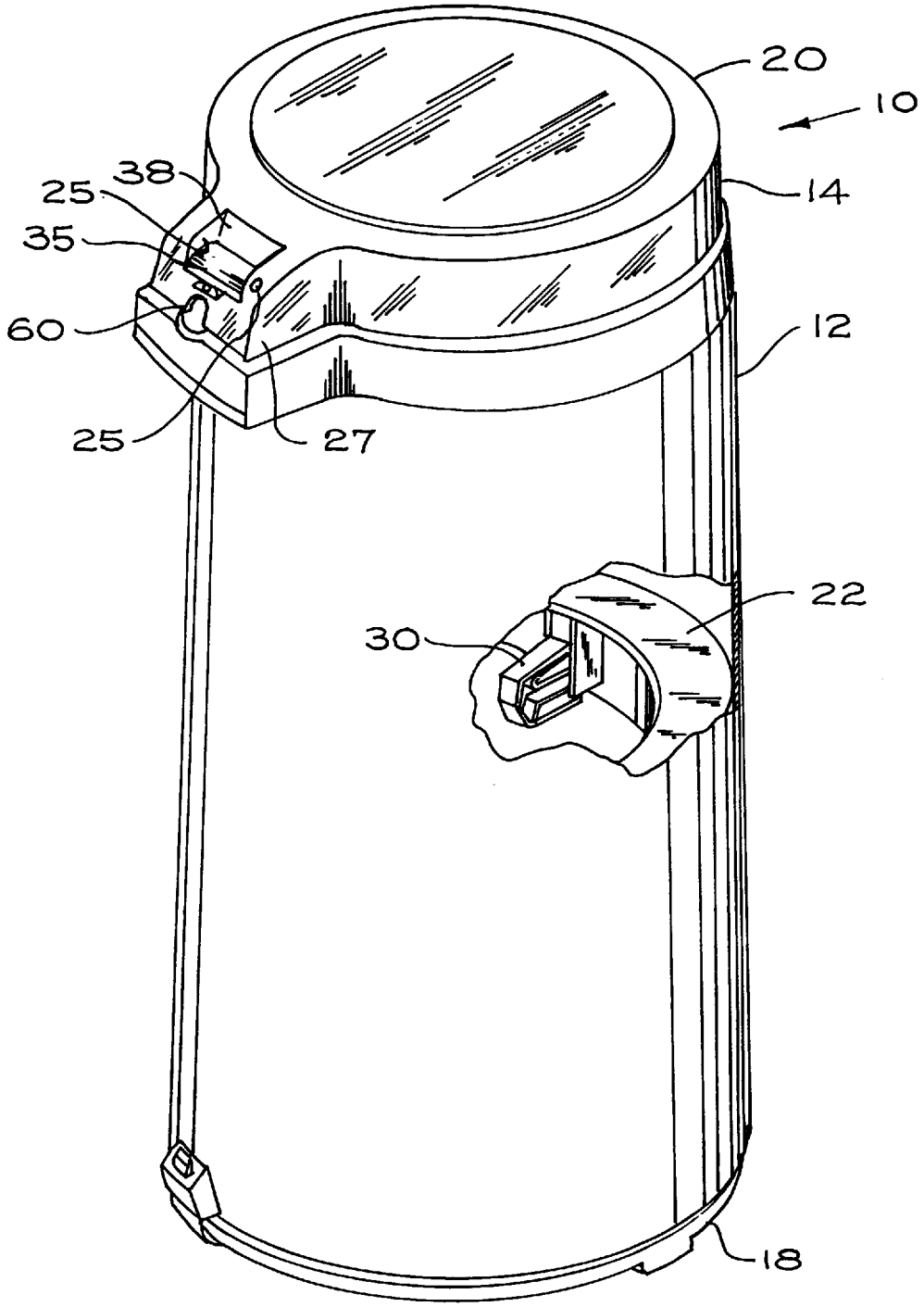
FIG. 1 illustrates a package disposal device constructed in accordance with one preferred embodiment of the present invention.

Referring to the figures and more particularly to FIG. 1, a device in accordance with one form of the present invention is illustrated at 10. The device 10 comprises a substantially cylindrical container 12 having a removable cover 14 at the top of the cylindrical container 12 and an access door 18 at the bottom of the cylindrical container 12. The removable cover 14 has an opening covered by a hinged lid 20. A ring-shaped flange 22 is located inside the cylindrical container 12, and a tubular core 24 rests on the flange 22. Continuous length flexible tubing 26 is stored within the tubular core 24. A twist rim 28 is rotatably coupled to the tubular core 24. Rotating the twist rim 28 twists the flexible tubing 26.

A plurality of retention springs 30 are attached to the flange 22. The retention springs 30 hold a waste package 32 within the flexible tubing 26 stationary while the twist rim 28 rotates to twist the flexible tubing 26 and seal the end of the waste package 32. An aperture in the twist rim 28 preferably contains a clear plastic panel. In one preferred embodiment of the present invention, the twist rim 28 incorporates a cutting device 36 to sever the flexible tubing 26 when the cylindrical container 12 is filled.

The cover 14 is removably attached to the cylindrical container 12. When the cover 14 is removed, an end of the flexible tubing 26 can be removed from the roll of flexible tubing 26 contained within the tubular core 24 and knotted. This knot of flexible tubing 26 is then placed into the cylindrical container 12 through the flange 22 toward the bottom of the cylindrical container 12 and forms a bag for storing waste packages 32. Waste packages 32 are placed into the bag formed by flexible tubing 26, and the flexible tubing 26, together with the waste package 32, is held stationary by the plurality of retention springs 30 inside of the cylindrical container 12 coupled to the flange 22.

Figure 2A:
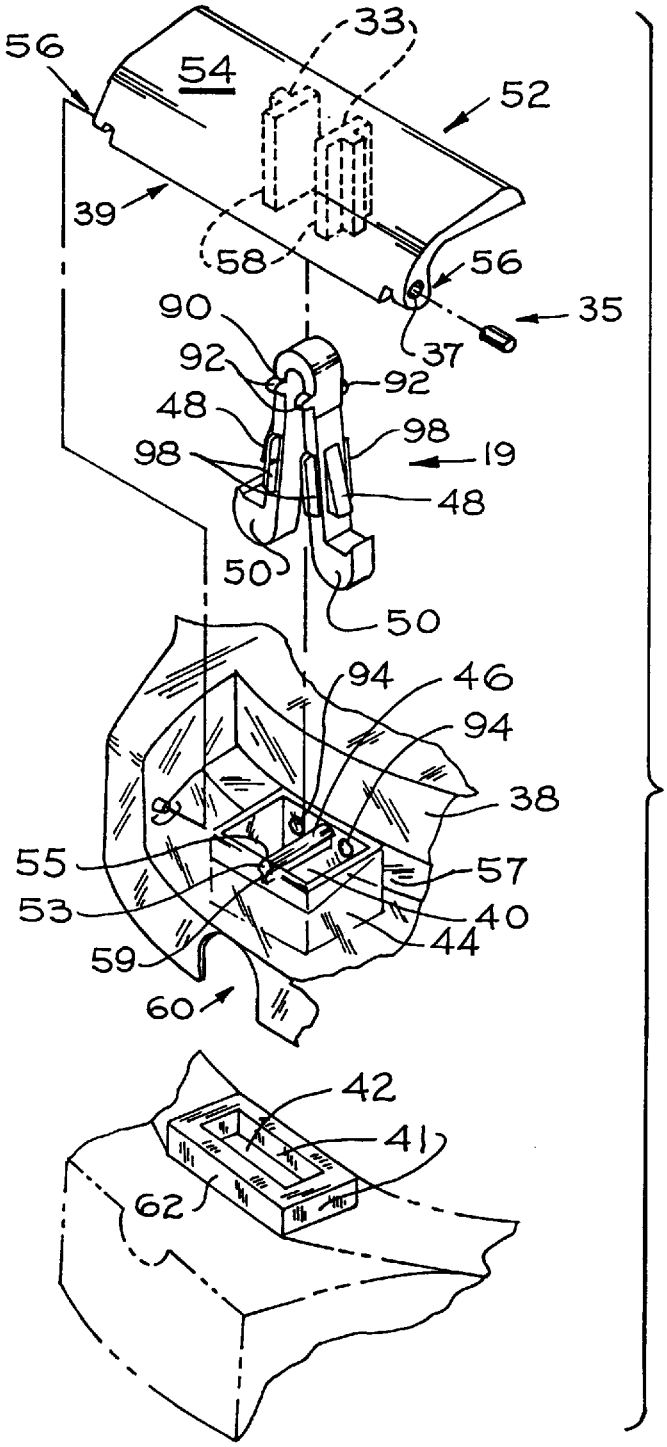
FIG. 2*a* is an enlarged, fragmentary, exploded perspective view of the cover, lid, and latch of the package disposal device of FIG. 1.
Figure 2B:
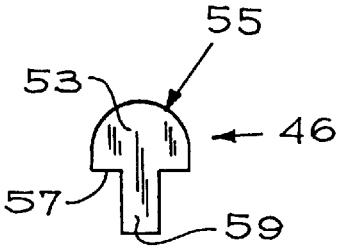
FIG. 2*b* is an enlarged end view of a support that supports the latch spring.

Referring also to FIGS. 2*a* and 2*b*, once the waste package 32 is deposited in the flexible tubing 26 and the cover 14 is closed, the hinged lid 20 can be opened using a latch 35. The latch 35 comprises a button 52 and a latch spring 19. The latch 35 is preferably located in a recessed area 38 of the hinged lid 20. A rectangular slot 40 is molded into the bottom of the recessed area 38 of the hinged lid 20, and a corresponding slot 42 is molded into the cover 14 such that the slots 40, 42 substantially coincide when the hinged lid 20 is in the closed position against the cover 14. The four sides of the rectangular slot 40 in the hinged lid 20 extend downward to form a parallelogram 44. A support 46 extends from the back wall 43 to the front wall 45 of the parallelogram 44.

The support 46 is preferably molded to the hinged lid 20. The support 46 comprises a substantially semi-circular portion 53 oriented such that a curved side 55 of the semi-circular portion 53 is at the top of the support 46. A substantially straight side 59 of the semi-circular portion 53 of the support 46 is located beneath the curved side 55 and is coupled, preferably by molding, to an elongated lower piece 59 below. The lower piece 59 preferably has a smaller width 61 than the diameter of the semi-circular portion 53 of the support 46.

The button 52 is located in the recessed area 38 of the hinged lid 20 directly above the slots 40, 42. The button 52 preferably comprises an upper surface area 54, two aligned pivot points 56, and two substantially parallel surfaces 58. The substantially parallel surfaces 58 can, in a preferred embodiment of the present invention, each comprise a stiffening rib 33 extending perpendicular to and along the outside length of the parallel surfaces 58.

The upper surface area 54 of the button 52 is depressed to actuate the latch 35. The two aligned pivot points 56 pivotably affix the button 52 to the hinged lid 20. In one preferred embodiment of the present invention, the two pivot points 56 comprise two projections 25 at the front edge 27 of the recessed area 38 of the hinged lid 20 which conform to two indentations 37 preferably molded at the front edge 39 of the button 52. Alternatively, the projections can be molded into the button 52 and indentations can be molded or otherwise formed in the recessed area 38 of the hinged lid 20. The parallel surfaces 58 preferably extend substantially perpendicularly from the upper surface area 54 and surround the latch spring 19.

The latch spring 19 preferably comprises the pair of dual catches 48. The dual catches 48 form an inverted U-shape and are centered on the support 46 such that the curvature of the U-shape 49 is adjacent to the semi-circular portion 53 of the support 46 and each of the catches 48 of the latch spring 19 extends downward. The dual catches 48 each comprise two projections 92 at the termination of the curved portion 90 of the dual catches 48 which extend from the dual catches 48 to the back wall 43 and the front wall 45 of the parallelogram 44. The projections 92 correspond to and fit within nooks 94 molded into the parallelogram 44 of the hinged lid 20. The projections 92 and nooks 94 operate to maintain the position of the latch spring 19 with respect to the hinged lid 20.

The dual catches 48 extend below the bottom edges 47 of the parallelogram 44 as well as below the sides 41 of the corresponding slot 42 in the cover 14. The dual catches 48 hold the hinged lid 20 against the cover 14 with two hooks 50 extending substantially perpendicular from the dual catches 48. The dual catches 46 can additionally comprise segments 98 below the support 48 extending nearly to the back wall 43 and the front wall 45 of the parallelogram 44 which maintain the vertical alignment of the dual catches 48 with respect to the walls 43, 45 of the parallelogram 44.

Pressing the upper surface area 54 depresses the button 52 and forces the two parallel surfaces 58 to move into the rectangular slot 40 of the hinged lid 20. The parallel surfaces 58 push the dual catches 48 of the latch spring 19 inward. Once the button 52 is sufficiently depressed, the dual catches 48 are pushed together and can slide through the corresponding slot 42 in the cover 14. When the dual catches 48 can slide through the corresponding slot 42 in the cover 14, the hinged lid 20 can be pivotably opened by applying an upward force on the lifting handle 60 of the hinged lid 20. The hinged lid 20 win not open if the button 52 is depressed without applying an independent upward force on the lifting handle 60. Further, the hinged lid 20 cannot open if the lifting handle 60 is not lifted when the button 52 is not depressed.

The hinged lid 20 can be closed from an open position by pushing the hinged lid 20 downward until it rests on the cover 14. The sides 41 of the corresponding slot 42 extend down and inward to form a ridge 62. When the hinged lid 20 in pushed downward onto the cover 14, the hooks 50 on the dual catches 48 are pushed inside the corresponding slot 42 and caught by the ridge 62. The hooks 50 on the dual catches 48 are identical in one preferred embodiment of the present invention, but are not required to be. It will be apparent to one of ordinary skill in the art that a variety of shapes of hooks 50 can be used satisfactorily. Unless the button 52 is depressed while the lifting handle 60 is lifted, the hinged lid 20 win remain in the closed position. The present invention is designed to prevent accidental spills by requiring two distinct motions to open the latch 35 of the hinged lid 20: (1) a depressing motion to unlock; and (2) a lifting motion to open.

The twist rim 28 is accessible when the hinged lid 20 is in the open position. Rotating the twist rim 28 twists the flexible tubing 26 not held stationary by the weight of the waste package 32 resting on the retention springs 30 while the flexible tubing 26 resting on the plurality of retention springs 30 is held stationary. Thus, the flexible tubing 26 located above the waste package 32 twists and seals as the flexible tubing 26 is pinched together by the rotation of the twist rim 28 and encloses the waste package 32 individually. In one embodiment of the present invention, a user can see whether the flexible tubing 26 is sufficiently sealed through the clear plastic panel contained in the twist rim 28.

Once a waste package 32 is sealed, the waste package 32 can be pushed downwardly past the retention springs 30 into the cylindrical container 12. Successive waste packages 32 can be sanitarily stored in the cylindrical container 12 because each waste package 32 is individually sealed. Once the cylindrical container 12 is filled, the cutting device 36 incorporated into the twist rim 28 can be used to sever the end of the most recently disposed waste package 32 from the roll of flexible tubing 26, and the series of waste packages 32 can be removed from the cylindrical container 12 through the bottom access door 18.

Figure 3:
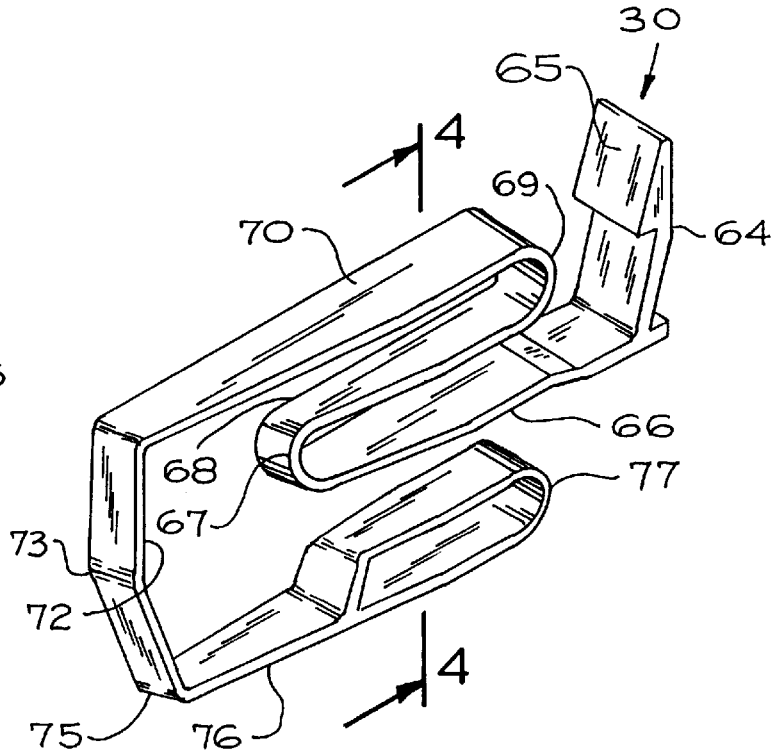
FIG. 3 illustrates a perspective view of a retention spring constructed in accordance with one preferred embodiment of the present invention.
Figure 4:
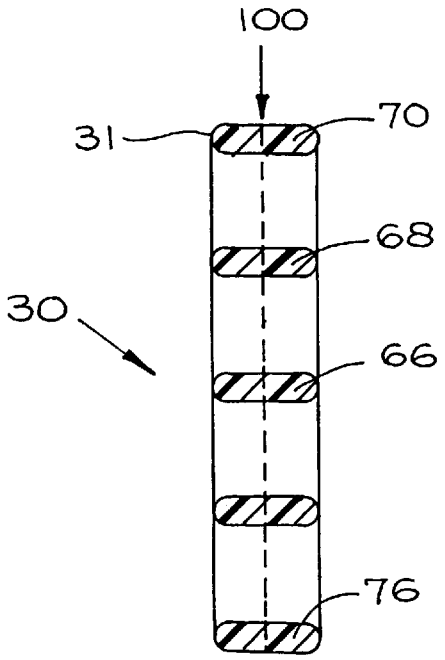
FIG. 4 shows a sectional view of a retention spring taken along line 4—4 of FIG. 3.
Figure 5:
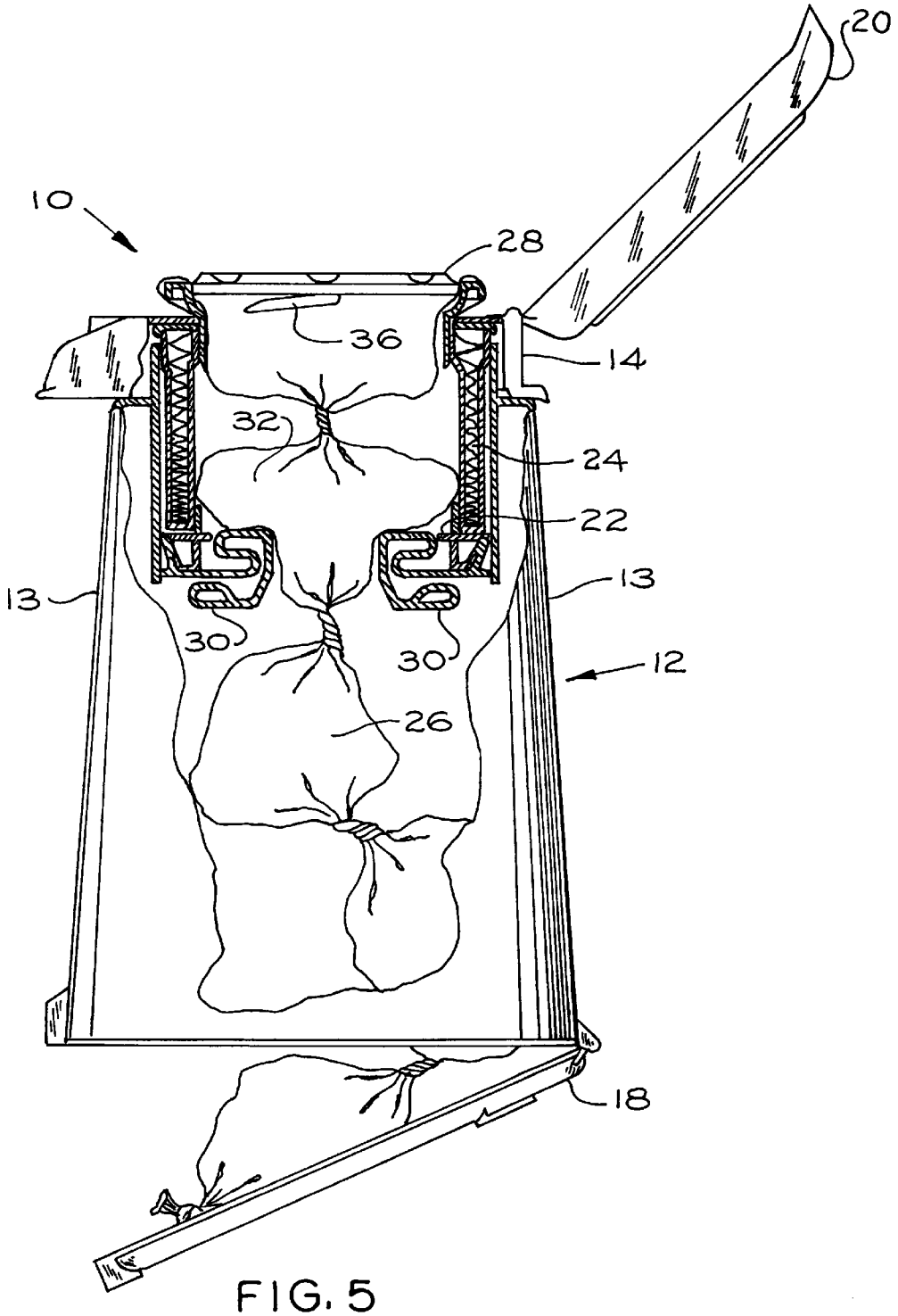
FIG. 5 illustrates a sectional view of the disposal device of FIG. 1.

Referring to FIGS. 3–5, the retention springs 30 are preferably formed from a single piece using a series of bends. In one preferred embodiment of the present invention, plastic is used to construct the retention springs 30. In such an embodiment, each retention spring 30 can be molded such that a parting line 100 is located along the center 102 of each of the retention springs 30. Preferably, the thickness of the retention spring 30 is greatest at the parting line 100 and narrows toward the edges 31 of the retention springs 30 as shown in FIG. 4. This narrowing can be substantially linear, elliptical, or spherical. Such configurations concentrate force along the center of each retention spring 30 which improves the gripping and holding action of the device 10. These configurations improve the force and pressure distribution to gently retain the waste package 32 while the device 10 is operated.

The retention springs 30 are affixed to openings 23 in the flange 22 with a plastic upright 64 forming a hook 65. The plastic upright 64 is attached to a base section 66 which extends inward to the center of the cylindrical container 12 substantially perpendicular to the wall 13 of the cylindrical container 12. The base section 66 is terminated by a first one-hundred-eighty degree semi-circular turn 67 upward and back toward the wall 13 of the cylindrical container 12.

A second section 68 begins at the first one-hundred-eighty degree turn 67 and runs above and substantially parallel to the base section 66. The second section 68 terminates with a second semi-circular one-hundred-eighty degree turn 69 upward. A top section 70 extends from the second semi-circular one-hundred-eighty degree turn 69 above and substantially parallel to the second section 68 and perpendicular to the wall 13 of the cylindrical container 12 inward toward the center of the cylindrical container 12. The top section 70 exceeds the length of the base section 66 and the second section 68 before terminating in a ninety degree turn 71. The ninety degree turn 71 marks the highest and inwardmost point of each of the retention springs 30 of said plurality and is rounded.

An innermost section 72 extends downward substantially parallel to the wall 13 of the cylindrical container 12 and, after making approximately a thirty degree turn 73 outward toward the wall 13 of the cylindrical container 12, becomes an angled section 74. The angled section 74 bends the remainder of ninety degrees 75 to form a bottom section 76 extending toward and substantially perpendicular to the wall 13 of the cylindrical container 12. The bottom section 76 terminates with one-hundred-eighty degree turn 77 and runs parallel above the bottom section 76 inward and can be molded back into the bottom section 76.

The relative lengths of the retention spring 30 sections in one embodiment of the present invention are as follows: the base section 66 and the top section 70 are substantially equal in size; the second section 68 and the bottom section 76 are substantially equal; the innermost section 72 is half of the length of the second section 68; and the angled section 74 is longer than the innermost section 72. Constructing the retention springs 30 in accordance with these lengths has been found to provide excellent package retention and ease of use.

In one embodiment of the present invention, the cross-sectional area of the retention springs 30 decreases as the retention springs 30 extend inward to the center of the cylindrical container 12. In this embodiment, when the retention springs 30 are viewed from the top of the device 10 the retention springs 30 are widest at the wall 13 of the cylindrical container 12 and narrowest at the point nearest the center of the cylindrical container 12. This innovation is an improvement over prior art devices wherein the width of the supporting springs is uniform. Tapering the width of the retention springs 30 reduces the effective cross-sectional area, thereby increasing the pressure on remaining portions of the retention spring 30. The area reduction, therefore, provides an improved method of holding waste packages 32 stationary while the device is used to twist the waste package 32 closed.

The width of the retention springs 30 can be reduced at the innermost section 72 as much as a quarter (25%) or more of the width of said retention springs 30 at the wall 13 of the cylindrical container 12. Another alternative embodiment of the present invention is designed such that the cross-sectional area of the retention springs 30 decreases on the vertical plane as the retention springs 30 approach the center of the cylindrical container 12. The decrease in cross-sectional area of the retention springs 30 can be accomplished using a constant reduction in cross-section as the retention springs 30 approach the center of the cylindrical container 12.

The improved retention spring 30 design of the present invention allows less material to be used to construct the retention springs 30 and concentrates both the radial and axial forces provided by the retention springs 30. Furthermore, forces are oriented to the center of the cylindrical container 12 and perpendicular to the waste packages 32 being sealed, while retaining sufficient rigidity of the springs 30 to prevent undesired deformation of the spring 30 such as twisting out of shape while the waste package 32 is being sealed.

In addition, the improved retention spring design 30 requires less force to push waste packages 32 past the retention springs 30 into the cylindrical container 12. The retention springs 30 deform axially and radially to accommodate the waste packages 32 as the waste packages 32 are downwardly pressed past the retention springs 30 into the cylindrical container 12. The deformation on the retention springs 30 when waste packages 32 are pressed past the retention springs 30 will change the relative locations and orientations of the retention spring 30 components from one another.

The edges 31 of the retention springs 30 of the preferred embodiment can be molded or otherwise formed such that, the top and bottom edges 31 of the retention springs 30 can be rounded as shown in FIG. 4 or just the top edges alone can be rounded. An additional alternative embodiment of the present invention incorporates retention springs 30 mounted other than substantially perpendicular to the wall 13 of the cylindrical container 12. This orientation of the plurality of retention springs 30 serves to further assist stabilizing the flexible tubing 26 holding the waste package 32 as the device 10 twists and seals the flexible tubing 26.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A device for packaging a series of packages of waste in a continuous length of flexible tubing, said device comprising:

a container having a removable cover at one end and an access door at the other end, said removable cover having an opening covered by a hinged lid;

a tubular core for storing a supply of flexible tubing;

a ring-shaped flange located inside said container upon which the tubular core rests;

a twist rim coupled to said tubular core and capable of twisting said flexible tubing;

a plurality of retention springs spaced around said container for holding the waste package stationary while said twist rim is twisting the flexible tubing; and a latch mechanism for latching said hinged lid to said removable cover, said latch mechanism including a latch spring, a button coupled to said latch spring for operating said latch spring between a latching condition in which said latch spring latches said hinged lid to said removable cover and an unlatching condition in which said hinged lid is unlatched from said removable cover, and a lifting handle on said hinged lid to facilitate pivoting of said hinged lid relative to said removable cover to an open position when said latch spring is in its unlatching condition.

2. The device of claim 1, wherein releasing said hinged lid requires simultaneously depressing said button and lifting said hinged lid by said lifting handle.

3. The device of claim 2, wherein said lifting handle on said hinged lid is located adjacent to the latch mechanism for allowing a person to engage said lifting handle and said button with fingers of one hand for simultaneously depressing said button and lifting said hinged lid by said lifting handle during pivoting of said hinged lid to the open position.

4. The device of claim 1, wherein said latch spring comprises a substantially U-shaped member.

5. The device of claim 4, wherein said hinged lid includes a support having a semi-circular portion, said U-shaped member being coupled to said semi-circular support portion, and said U-shaped member including at least one projection cooperating with said hinged lid for maintaining the position of said latch spring with respect to said hinged cover.

6. The device of claim 4, wherein said button includes two substantially parallel surfaces, said latch spring including first and second catches which engage said removable cover to hold said hinged lid against said removable cover when said latch spring is in the latching condition, and wherein depressing said button causes said substantially parallel surfaces to move said first and second catches of said latch spring out of engagement with said removable cover to release said hinged lid from said removable cover when said latch spring is operated to the unlatching condition.

7. The device of claim 4, wherein said first and second catches include first and second hooks, respectively, extending outwardly from said catches and which engage the removable cover when said latch spring is in the latching condition.

8. A device for packaging a series of packages of waste in a continuous length of flexible tubing, said device comprising:

a container having a removable cover at one end and an access door at the other end, said removable cover having an opening covered by a lid;

a tubular core for storing a supply of flexible tubing, a ring-shaped flange located inside said container upon which the tubular core rests;

a twist rim coupled to said tubular core and capable of twisting said flexible tubing;

a latch mechanism for securing said lid to said removable cover; said latch mechanism including a latch spring having first and second catches for coupling the lid to said removable cover, and a button for moving said first and second catches to release said lid from said removable cover to allow the lid to be moved to an open position relative to said removable cover.

9. A device for packaging a series of packages of waste in a continuous length of flexible tubing, said device comprising:

a container having a removable cover at one end and an access door at the other end, said removable cover having an opening covered by a hinged lid;

a tubular core for storing a supply of flexible tubing, a ring-shaped flange located inside said container upon which the tubular core rests;

a twist rim coupled to said tubular core and capable of twisting said flexible tubing when said twist rim is rotated; and a plurality of retention springs spaced around said container for holding the waste package stationary while said twist rim is rotated, each of said retention springs including a mounting portion for securing the retention spring to a wall of said container and at least one section extending inwardly toward the center of said container for engaging and holding the waste package, the at least one inwardly extending section having a cross-sectional area that decreases along the length of the section toward the center of said container.

10. The device of claim 9, wherein the width of the at least one inwardly extending section decreases in a direction from the wall of the container towards the center of the container.

11. The device of claim 9, wherein the at least one inwardly extending section of the retention spring terminates in an approximately 90° bend, defining a first spring portion that extends substantially parallel to the wall of the container, and a second spring portion extending outward from the first spring portion towards the wall of the container at an angle relative to the first spring portion.

* * * * *